United States Patent [19]

Haruguchi et al.

[11] Patent Number: 4,712,499

[45] Date of Patent: Dec. 15, 1987

[54] METHOD OF MOUNTING BLISTER ON SHIP'S HULL IN DRY DOCK

[75] Inventors: Kenji Haruguchi; Takuma Kohguchi; Osamu Sekiya, all of Yokohama, Japan

[73] Assignee: Sumitomo Heavy Industries, Ltd., Tokyo, Japan

[21] Appl. No.: 886,706

[22] Filed: Jul. 18, 1986

[30] Foreign Application Priority Data

Jul. 19, 1985 [JP] Japan ..... 60-159471

[51] Int. Cl.[4] ..... B63B 9/06

[52] U.S. Cl. ..... 114/77 R; 414/348; 414/786; 114/123; 114/65 R

[58] Field of Search ..... 114/44, 45, 65 R, 77 R, 114/122, 123, 125; 414/786, 348, 347, 389, 391, 399

[56] References Cited

U.S. PATENT DOCUMENTS 2,385,985 10/1945 Harrison ..... 114/122

FOREIGN PATENT DOCUMENTS 0167392 9/1984 Japan ..... 114/65 R 0167393 9/1984 Japan ..... 114/65 R

OTHER PUBLICATIONS

Newport News "Shipyard Bulletin" vol. XXIII, Aug. 1963, No. 4.

*Primary Examiner*—Jeffrey V. Nase
*Assistant Examiner*—Edwin L. Swinehart
*Attorney, Agent, or Firm*—Armstrong, Nikaido, Marmelstein & Kubovcik

[57] ABSTRACT

A method of attaching a blister to the shell of a ship such as an aircraft carrier in a dry dock. The method comprises providing rails on the bottom of the dry dock along the dry dock side where the blister is to be attached to the ship shell such that the rails extend in the longitudinal direction of the dry dock, placing the blister member, with a guide member thereon, on a truck and moving the truck, with the blister member thereon, along the rails to a position where the blister block is to be fixed to the ship shell and, while engaging the guide member with the side of the dry dock, raising the blister member so as to engage the ship shell and fixing the raised blister member to the ship shell.

3 Claims, 3 Drawing Figures

METHOD OF MOUNTING BLISTER ON SHIP'S HULL IN DRY DOCK

BACKGROUND OF THE INVENTION

1. Field of the Invention:

The present invention relates to a method of remodelling large-sized special ships or vessels such as an aircraft carrier, a large-sized catamaran, an offshore structure and so forth and, more particularly, to a method of attaching a blister to the hull of such a ship or a structure in a dry dock.

2. Description of the Prior Art:

It is a common measure to improve the buoyancy or the stability of a vessel by attaching blisters or bulges to the ship's sides.

The attaching of the blister or the bulge is conducted while the ship is situated in a dry dock. The work for attaching a blister or bulge, however, encounters a problem particularly when the ship is a large-sized and specially shaped one, e.g., an aircraft carrier Namely, in such a case, it is very difficult to access the lower portion of the hull vertically from the upper side of the ship and the working space is seriously limited, partly because the clearance between the hull and the wall of the dock is very small and partly because an upper structure such as a flight deck projects laterally above the banks of the dry dock. In case of a large-sized catamaran, the upper structure such as house makes it difficult to access the lower portion of each hull, thus causing an impediment to the work for attaching blisters.

Due to these difficulties, the work for attaching blisters to such specially-shaped large-sized ships has been conducted either by a method in which the blister is divided into a plurality of small sections which are brought to the ship's side one by one by means of, for example, chain blocks and assembled one after another to complete the blister on each side of the ship's hull, or by a method in which obstacles such as the flight or upper deck or other obstacles projecting laterally from the deck are temporarily removed and the blister as an assembly is lowered by a crane such as a goliath crane to a position where it faces the ship's side, through the clearance formed after the removal of the obstacle, followed by remounting of the obstacles after the attaching of the blister.

The first-mentioned method, however, requires a long time and the efficiency of the work is inevitably lowered due to the fact that most of the work has to be done by manual labour. The first-mentioned method also requires the use of scaffolds and platforms, which is rather inconvenient from the view point of safety.

On the other hand, the second-mentioned method requires additional work for removing the obstacles projecting from the flight or upper deck, as well as remounting of the same after the attaching of the blister. Thus, much labour and long time are spent for works other than the work for attaching the blister.

SUMMARY OF THE INVENTION

Accordingly, an object of the invention is to provide a method which enables attaching of a large blister block to each side of the hull of a large-sized and specially-shaped ship or structure in a dry dock, with high efficiency and safety while shortening the construction term, thereby overcoming the above-described problems of the prior art.

To this end, according to the invention, there is provided a method of attaching a blister to the shell of a ship or the like structure in a dry dock, comprising: laying rails on the bottom of the dry dock along the area near the shell of the ship such that the rails extend in the longitudinal direction of the dry dock; movably mounting at least one truck on said rails; placing a blister block on said truck; moving the truck carrying the blister block to a position where the blister block is to be attached to the shell; and fixing the blister block to the shell.

In a specific form of the invention, a guide member with guide rollers is attached to the upper portion of the surface of the blister block adjacent the dock wall, so that the blister block on the truck is slightly inclined towards the dock wall such that the guide rollers roll along the dock wall.

The above and other objects, features and advantages of the invention will become more clear from the following description of the preferred embodiment taken in conjunction with the accompanying drawings.

DESCRIPTION OF THE PREFERRED EMBODIMENT

The accompanying drawings show an embodiment of the method of the invention which is applied to attaching of a blister block which is denoted by a numeral 2 to each side of the shell 1 of the hull of an aircraft carrier.

Figure 2:
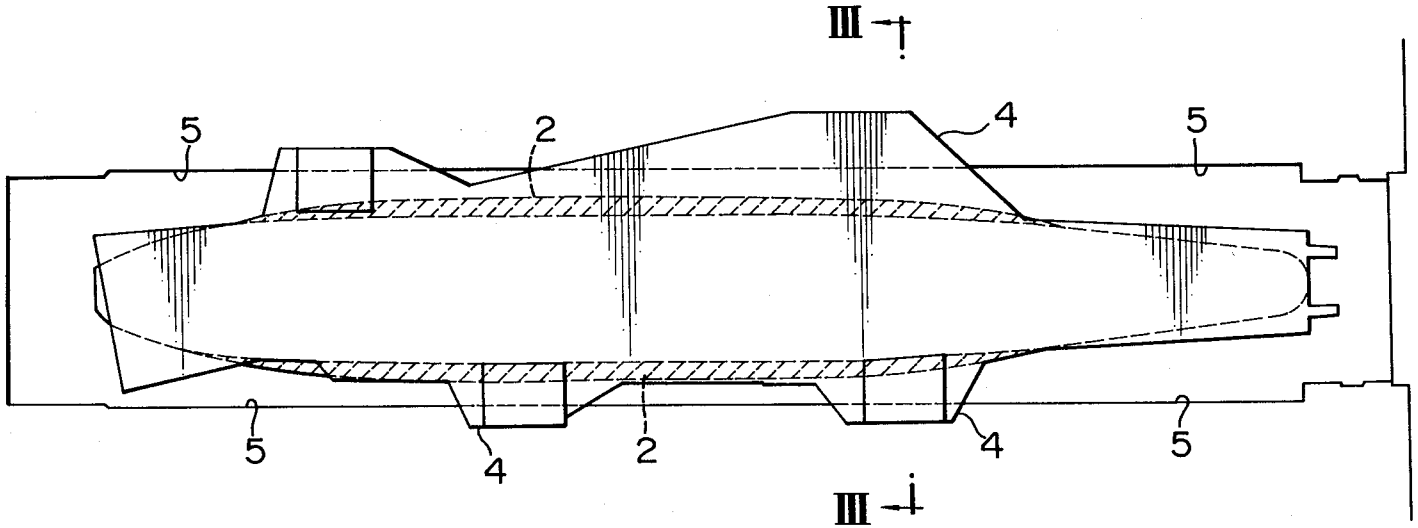
FIG. 2 is a plan view of an aircraft carrier situated in a dry dock.
Figure 3:
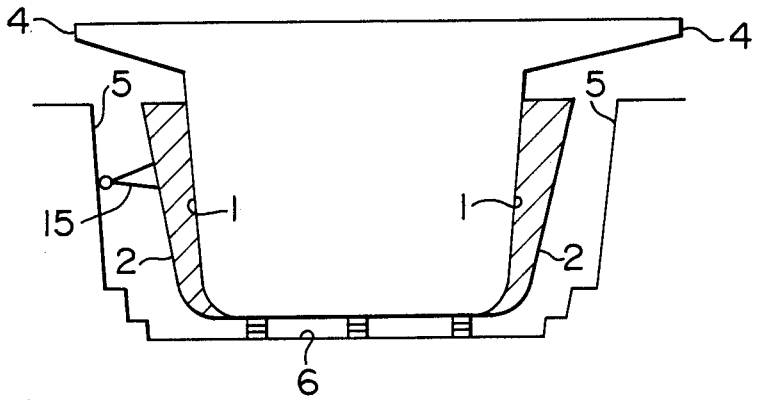
FIG. 3 is an enlarged sectional view taken along the line III—III of FIG. 2.

As shown in FIGS. 2 and 3, the aircraft carrier seated in a dry dock has obstacles such as catapult deck 4, aircraft lift and so forth which project laterally beyond the upper flight deck so as to hinder access of the blister block 3 to the shell 1 of the hull from the position right above these obstacles. The present invention proposes to make an efficient use of the space between the shell 1 of the hull and the adjacent dock wall 5, as the working space and also as the passage for allowing the blister block to approach the destined portion of the shell 1 of the hull, so that the blister block 3 can be attached to the side of the hull without requiring temporary removal of the obstacles 4, as will be understood from the following description.

Figure 1:
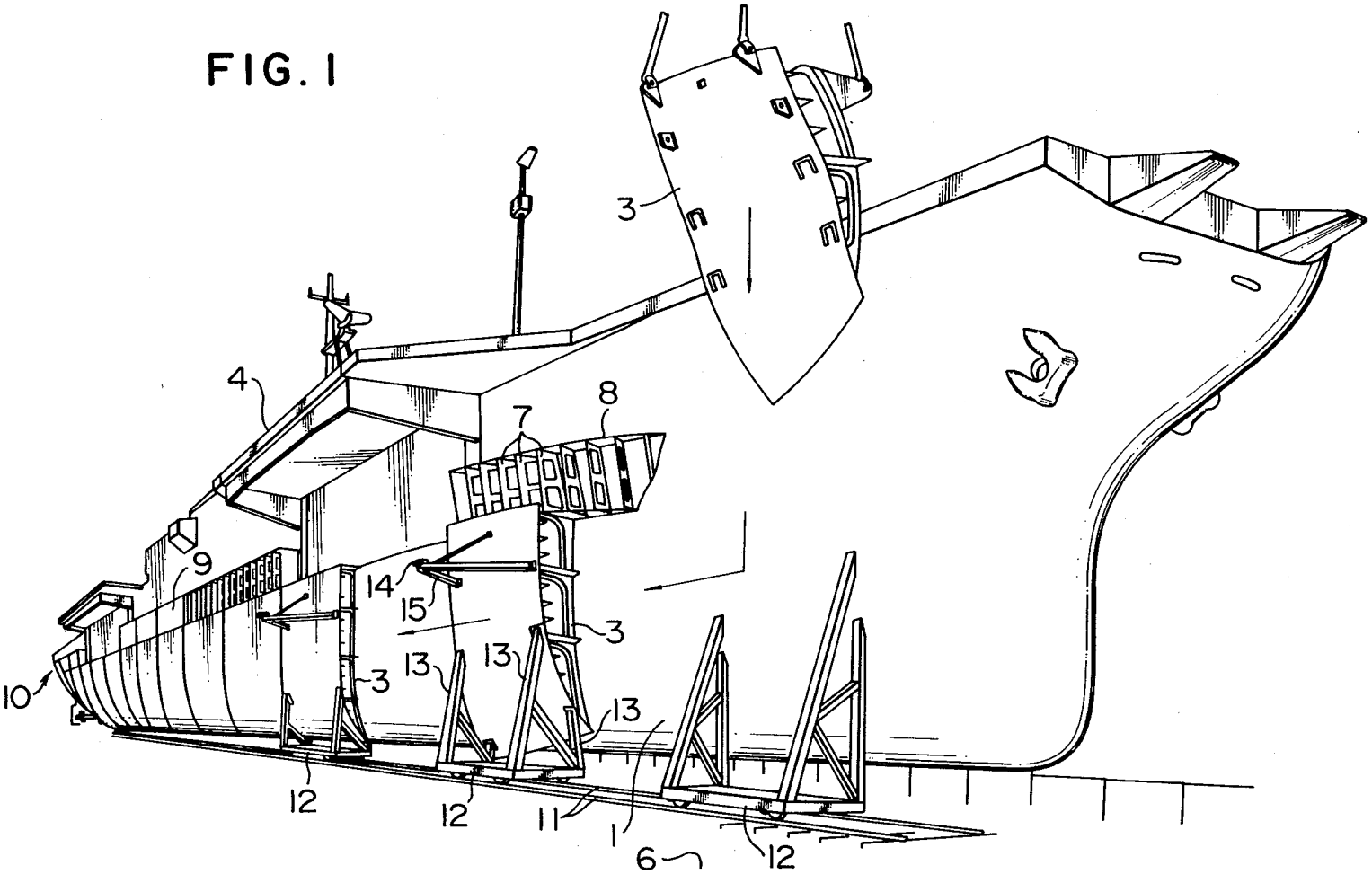
FIG. 1 is a perspective view of an aircraft carrier in a dry dock, with a blister block which is to be attached to the side of the hull of the aircraft carrier in accordance with the method of the invention.

Referring to FIG. 1, a structure 10, which is constituted by a plurality of ribs 7 and top panels 8 is formed on an upper portion of the shell 1 of the hull. Outer panels 9 are attached later so as to complete the structure 10.

On the other hand, rails 11 are laid on the bottom 6 of the dry dock so as to extend in the longitudinal direction of the dock. A plurality of trucks 12 are adapted to run along the rails 11. Each truck is capable of carrying a blister block 3. The blister block 3 is provided with engaging members which are adapted to be engaged by the ends of arms 13 on each truck 12. A guide member 15 attached to an upper portion of each blister block 3 has a guide roller 14 which is adapted to roll on the wall of the dock. The blister block 3 on the truck 12 is slightly inclined towards the dock wall such that its center of moss is somewhat offset towards the dock wall. The blister block 3 is therefore supported both by the arms 13 of the truck 12 and the guide member 15. The truck 12 is first moved along the rails 12 to an area where there is no obstacle, e.g., an area near the bow as illustrated, can catch the blister block 3 directly from a crane such as a goliath crane and then moved to the destined position along the rails 11. The blister block 3 is moved upward and located in contact with the lower ends of the ribs 7 and then welded to the shell 1 of the hull. Finally, the side panels 9 are hermetically welded both to the top panels 8 and the blister block. In this embodiment, there is no risk for the truck to turn sideways and there is no risk for the blister block 3 to collide with the shell 1 of the hull, by virtue of the guide member 15 which allows the blister block 3 to be held on the truck 12 in a slight inclination towards the dock wall. It is also to be noted that the truck 12 is significantly unburdened because a part of the load is shared also by the dock wall through the guide member 15. Needless to say, the engaging members and the guide member 15 are detached from the blister block 3 after the latter has been fixed to the shell 1 of the hull.

As will be realized from the foregoing description of the embodiment, the present invention offers the following advantages.

Firstly, the space between the shell of the hull and the dock wall is efficiently utilized as the working space, as well as a passageway for allowing the blister block 3 to approach the destined portion of the shell 1.

In addition, the method of the invention permits the use of dock facility such as a goliath crane which improves the efficiency of the work remarkably, thus shortening the construction term significantly.

Finally, it is to be noted that the work can be conducted in such a manner as to minimize the manual labour and to eliminate the installation of scaffolds and platforms on the dock floor, thus contributing to the safety of the work.

What is claimed is:

1. A method for attaching a blister along the side of the shell of a ship or similar structure in a dry dock having a bottom wall and side walls, said blister to be attached at said side of said ship shell adjacent the side wall of said dry dock, comprising: providing rails on the bottom of said dry dock along the sides of said shell of the ship on which said shell is to be attached such that each rail extends in the longitudinal direction of said dry dock along said dry dock bottom at a spaced distance from said dry dock side wall; movably mounting at least one truck on at least one of said rails; placing a blister block having a guide member for engaging said dry dock side wall on said truck; moving said truck carrying said blister block to a position where said blister block is to be attached to said shell; and, with said guide member engaging said dry dock side wall, raising said blister block off of said truck and fixing said blister block to said shell.

2. A method according to claim 1, wherein said guide member has a guide roller for engaging the surface of the adjacent dock wall.

3. A method according to claim 2 wherein said blister block is placed on said truck with the center of mass of said blister block inclined toward the immediately adjacent dry dock side wall and said truck, with said blister block so placed thereon being moved along said rail to said position where said blister block is to be attached with said guide member in engagement with said surface of said adjacent dock wall as said truck and said blister block are moved therealong.

* * * * *